United States Patent [19]

Yoshida

[11] 4,089,159

[45] May 16, 1978

[54] ELECTRONIC TIMEPIECE

[75] Inventor: Makoto Yoshida, Tokorozawa, Japan

[73] Assignee: Citizen Watch Company Limited, Tokyo, Japan

[21] Appl. No.: 698,454

[22] Filed: Jun. 21, 1976

[30] Foreign Application Priority Data

| | | |
|---|---|---|
| Jun. 23, 1975 | Japan | 50-77428 |
| Jul. 1, 1975 | Japan | 50-81228 |
| Jul. 7, 1975 | Japan | 50-83317 |
| Jul. 8, 1975 | Japan | 50-83150 |

[51] Int. Cl.[2] ..... G04B 37/12

[52] U.S. Cl. ..... 58/152 R; 58/4 A; 58/57.5

[58] Field of Search ..... 58/4 A, 23 R, 19 R, 58/50 R, 85.5, 58, 57.5, 152 R, 152 B; 235/152 R, 156

[56] References Cited

U.S. PATENT DOCUMENTS

| | | | |
|---|---|---|---|
| 3,745,761 | 7/1973 | Tsuruishi | 58/38 |
| 3,816,730 | 6/1974 | Yamamoto et al. | 235/156 |
| 3,822,547 | 7/1974 | Fujita | 58/152 B |
| 3,854,277 | 12/1974 | Samejima | 58/39.5 |
| 3,937,004 | 2/1976 | Natori et al. | 58/152 B |
| 3,946,549 | 3/1976 | Cake | 38/58 R |
| 3,955,355 | 5/1976 | Luce | 58/58 R |
| 3,961,472 | 9/1976 | Riehl | 58/4 A |
| 3,973,110 | 8/1976 | Rooe et al. | 235/152 |

*Primary Examiner*—B. Dobeck
*Assistant Examiner*—Vit W. Miska
*Attorney, Agent, or Firm*—Frank J. Jordan

[57] ABSTRACT

An electronic timepiece having a frequency standard, a frequency divider which divides an output frequency of the frequency standard to provide output pulse signals, a time counter driven by the output pulse signals from the frequency counter, and display means for displaying the contents of the time counter, in which a counter means is coupled to the time counter to form a serial counter chain and receiving an output signal from the time counter to perform a plurality of functions, and a change-over means is disposed in the counter chain between the time counter and the counter means, the change-over means selectively changing over the functions of the counter means.

44 Claims, 9 Drawing Figures

HOURS COUNTER 172
MINUTES COUNTER 144
FUNCTION SELECTION CIRCUIT 140
FUNCTION SELECTOR CIRCUIT 162
CORRECTION CONTROL CIRCUIT 208
OSCILLATOR CIRCUIT 202
FREQUENCY DIVIDER 204
SECONDS COUNTER 206
DECODER CIRCUIT 216
DISPLAY DRIVER CIRCUIT 218
ALARM DRIVING CIRCUIT 212
ALARM COINCIDENCE CIRCUIT 214
FROM FF 176 TO 200 AND FF 280 TO 314
AR
φCL
F
D

TO Fig.5B
TO Fig 5B

ELECTRONIC TIMEPIECE

This invention relates in general to a solid state electronic timepiece and more particularly to an improved circuit for an electronic solid-state wristwatch. The present invention permits additional functions other than the basic timekeeping function to be incorporated into a timepiece with a minimal increase in the number of circuit elements required to perform such functions, together with various other advantages to be described hereunder.

Digital electronic wristwatches which incorporate a quartz crystal frequency standard as the time base, C-MOS integrated circuits and electro-optical display elements are easily designed utilizing present-day technology. However the majority of such wristwatches being produced are capable of only computation and display of time. Various proposals have been made for techniques which would enable the display mechanism of the wristwatch to display other functions besides time. In most of these proposed techniques, separate function circuits are provided in addition to the time computing circuits, and the contents of such function circuits can be selected for display by means of some change-over selection device. The function circuits may store, for example timer data or alarm time data.

This approach, however, has the disadvantage that the number of circuits which must be incorporated within the timepiece are considerably increased, and as the number of functions increases, then the circuit complexity must also be greatly augmented.

In addition to this factor of circuit complication, it has been found that various problems have arisen with regard to the testing of the various function circuits incorporated into a multi-function wristwatch, and this has been one reason that such watches have not been extensively produced.

Also, for most of the multiple-function wristwatches which are at present being produced, the so-called 2-chip system of circuit construction is used. With this method, a separate integrated circuit chip is incorporated into the watch case, to perform the display of required additional functions, as well as the chip which is utilized to perform the normal timekeeping function. Although such a system is useful to a certain degree, it has some basic disadvantages, such as the fact that the use of two chips may cause the overall size of the watch to be increased, and the wiring interconnections between the chips lead to reduced reliability.

The present invention is directed toward overcoming the various defects of previous designs of multi-function electronic wristwatches as set out above, as well as providing other improvements in design described hereinafter. A watch constructed in accordance with the present invention can provide additional functions, such as an alarm time memory function, while utilizing a single integrated circuit chip. In the embodiment of the present invention to be described hereinafter, display stations which are normally used to display a part of the time data, namely the calendar data, can be utilized to display stored alarm time data, this data being held in a section of the circuitry normally utilized for the calendar function. The selection of either computation and display of calendar data or of storage and display of alarm time data is performed as the wearer requires, by actuation of an external control member. Since the sections of circuitry used for both the calendar function and the alarm time function are almost the same, the same external actuating members can be used to set in either the hours and minutes of a required alarm time of the days of months of the current calendar date. In addition, a method is described whereby the contents of the normal time counter circuits and the alarm function circuits can be brought into coincidence by actuation of a reset terminal. This provides a very rapid and simple test of the function circuit. Also described is a method whereby the calendar display is automatically correctly set to the first day of the following month subsequent to months with both odd and even numbers of days, and whereby a correction can be easily performed for the extra day in February of a leap year.

It is therefore one object of the present invention to provide an improved electronic wristwatch.

Another object of the present invention is to provide an improved electronic watch in which additional functions other than timekeeping may be performed and displayed, while utilizing circuitry and display stations normally used to compute and display a portion of the current time data to perform and display the additional functions, by means of a selector device.

Another object of the present invention is to provide an improved watch incorporating at least one additional function whereby means are provided such that the circuits utilized for the additional function or functions can be rapidly and easily tested.

Another object of the present invention is to provide an improved watch incorporating at least one additional function whereby all of the watch circuitry may be constructed upon a single integrated circuit chip.

Another object of the present invention is to provide an improved electronic watch which functions such that the calendar display is automatically correctly advanced to the first day of the following month at the end of each month.

These and other, objects, features and advantages of the present invention will be more apparent from the following description when taken in conjunction with the accompanying drawings, wherein.

Figure 1:
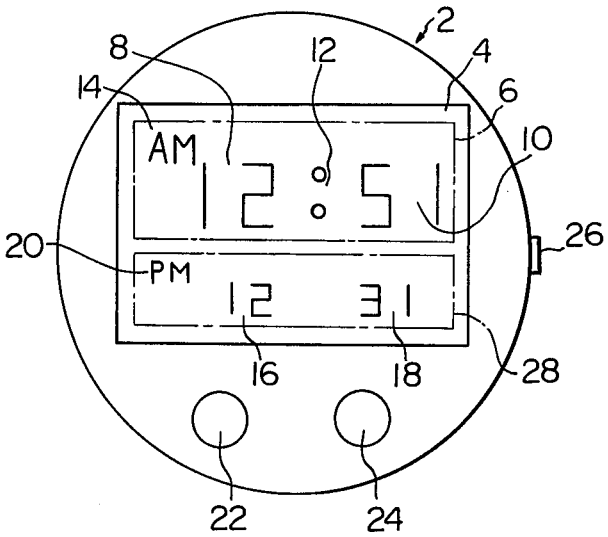
FIG. 1 is a view showing the face of a watch in accordance with the present invention, together with an illustrative arrangement of external control members on the case of such a watch.

Referring now to the diagrams, FIG. 1 is a front view of a digital electronic timepiece which incorporates both a calendar function and an alarm function, in such a way as to constitute an embodiment of the present invention. The numeral 2 indicates the digital electronic timepiece. A display section 4 comprises a current time display station 6 and a function display station 28. The current time display station 6 contains an hours display station 8, a minutes display station 10, a seconds colon symbol 12 and an AM/PM indicating symbol 14. The function display station 28 comprises a months display station 16, a days display station 18 and AM/PM indicating symbol 20 which is utilized for the alarm function. When the alarm function is selected by the timepiece wearer, as will be described hereinafter, then the months display station 16 and the days display station 18 are utilized to display the hours and minutes respectively of an alarm time stored in the timepiece.

A digit selector button 22 is used to select a display station for correction. A correction button 24 is used to rapidly correct a display station previously selected by use of the digit selector button 22. Numeral 26 indicates a function display selector member, utilized to change over from the calendar to the alarm function and vice versa. This member has two mechanically stable positions.

Figure 2:
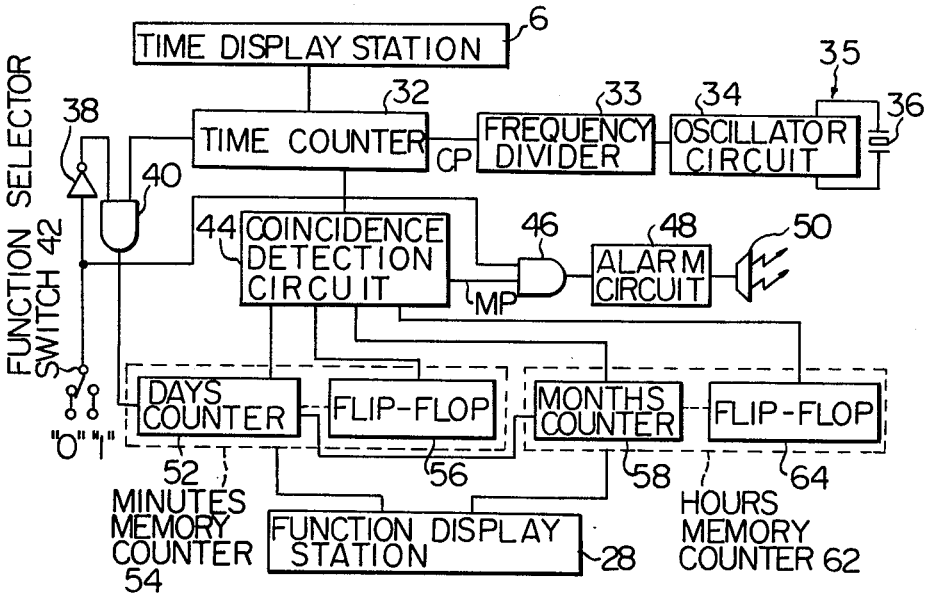
FIG. 2 is a simplified block diagram of the major circuit sections of a watch constructed in accordance with the present invention.

FIG. 2 shows a block diagram for the digital electronic timepiece shown in FIG. 1. A frequency standard 35 comprises a quartz crystal oscillator 36 and an oscillator circuit 34 connected thereto. Shown at 33 is a frequency divider circuit, which divides the frequency of the output of the crystal-controlled oscillator circuit 34 to provide an output clock pulse signal CP having a period of one second, this period being regulated by the quartz crystal 36. A time counter circuit 32 comprises a seconds counter, a minutes counter and an hours counter, though not shown. The outputs of these counters are applied to the respective display stations of time display station 6. Shown at 52 is a days counter, with a count capability to 40, which receives as input carry signals having a period of one day, applied from counter 32. Months counter 58, which counts to 12, receives as input a carry signal from the days counter 52 at the end of each month. The time counter 32, the days counter 52 and the months counter 58 are thus connected in series, when the timepiece is operated with the calendar function selected.

A description will now be given for the case of the alarm function being selected. In this case, a minutes memory counter 54 is shown as consisting of the days counter 52 connected in series with a single flip-flop (hereinafter abbreviated to FF) designated as 56. Since the days counter 52 has a count capability of 40, the addition of FF56 provides a count capability of 80 for the counter combination 54, so that a count to 60 for the minutes of alarm time can be performed. An hours memory counter 62 is provided with a memory capability of up to 24 hours, such that AM/PM data can be stored, by adding FF64 to the months counter 58.

The contents of the minutes memory counter 54 and the hours memory counter 62 are displayed on the respective portions of the function display station 28, when an alarm function has been selected.

A coincidence detection circuit 44 is coupled between the time counter 32, and the minutes memory counter 54 and hours memory counter 62, to generate a coincidence signal MP when the current time held in the time counter 32 comes into coincidence with an alarm time stored in the minutes memory counter 54 and the hours memory counter 62, the alarm time having been previously set into these counters by an alarm writing means to be described hereinafter. An alarm circuit 48 supplies an alarm actuating signal to an audible alarm unit 50 such as a buzzer in response to the alarm coincidence signal MP, thereby providing an audible alarm signal. A function selector switch is shown at 42, actuated by function selector member 26. The output from switch 42 is held at logic level "0" when the calendar function is selected, and at logic level "1" when the alarm function is selected. AND gate 40 forms part of change-over means and inhibits or permits the passage of carry signals from time counter 32 to the days counter 52 for the alarm or calendar functions respectively, gate 40 being controlled by the function selector switch 42, via an inverter 38.

AND gate 46 functions to inhibit the passage of the alarm coincidence signal MP to the alarm circuit 48 while the calendar function is selected.

Operation while the calendar function is selected is as follows. Since the output of function selector switch 42 is at the "0" logic level, then AND gate 40 is "on" and AND gate 46 is "off". Carry signals from the time counter 32, produced as a result of clock pulse signal CP from frequency divider circuit 33 pass through AND gate 40 and actuate the days counter 52. The carry output signal from the days counter 52 follows the path indicated by the solid line in the diagram, to actuate the months counter 58. The contents of the time counter 32 are displayed on time display station 6, while the month and day appear on function display station 28. If a coincidence signal MP is produced by coincidence circuit 44 in this case, the signal is inhibited by AND gate 46, and hence no audible alarm is generated by the buzzer 50.

When the function selector switch 42 is changed over to the alarm function, then the switch output is held at the logic level "1". AND gate 40 is thereby held in the "off" state, and AND gate 46 in the "on" state. Passage of the carry output from time counter 32 through AND gate 40 is therefore inhibited. Change-over of the function status also causes FF56 to be connected to days counter 52 by the path indicated as a broken line, and FF 64 is connected to the months counter 48 as shown by a broken line. The contents of the minutes memory counter 54, written into the counter by means to be described later, are displayed on the days display station 18 of the function display station 28, while the contents of the hours memory counter 62 appear on the months display station 16 and the alarm indicating AM/PM marker symbol 20.

When the contents of the memory counters 54 and 62 come into coincidence with the contents of the time counter 32, then the coincidence circuit 44 generates the alarm coincidence signal MP for a duration of 1 minute. Signal MP passes through AND gate 46 and actuates the alarm circuit 48 so that an audible alarm is produced by the buzzer 50 for one minute. If it is desired to stop the audible alarm before the end of this one minute period, this can be done simply by changing over the function selector switch 42 to the calendar function position.

The construction of an embodiment of a digital electronic timepiece in accordance with this invention will now be described in greater detail with reference to FIG. 3, which is based upon the contents of FIG. 2 with like symbols and numerals indicating like elements. The display devices and the correction means for the time counter are not relevant to the subject matter of the present description, and so are omitted from FIG. 3.

Figure 3:
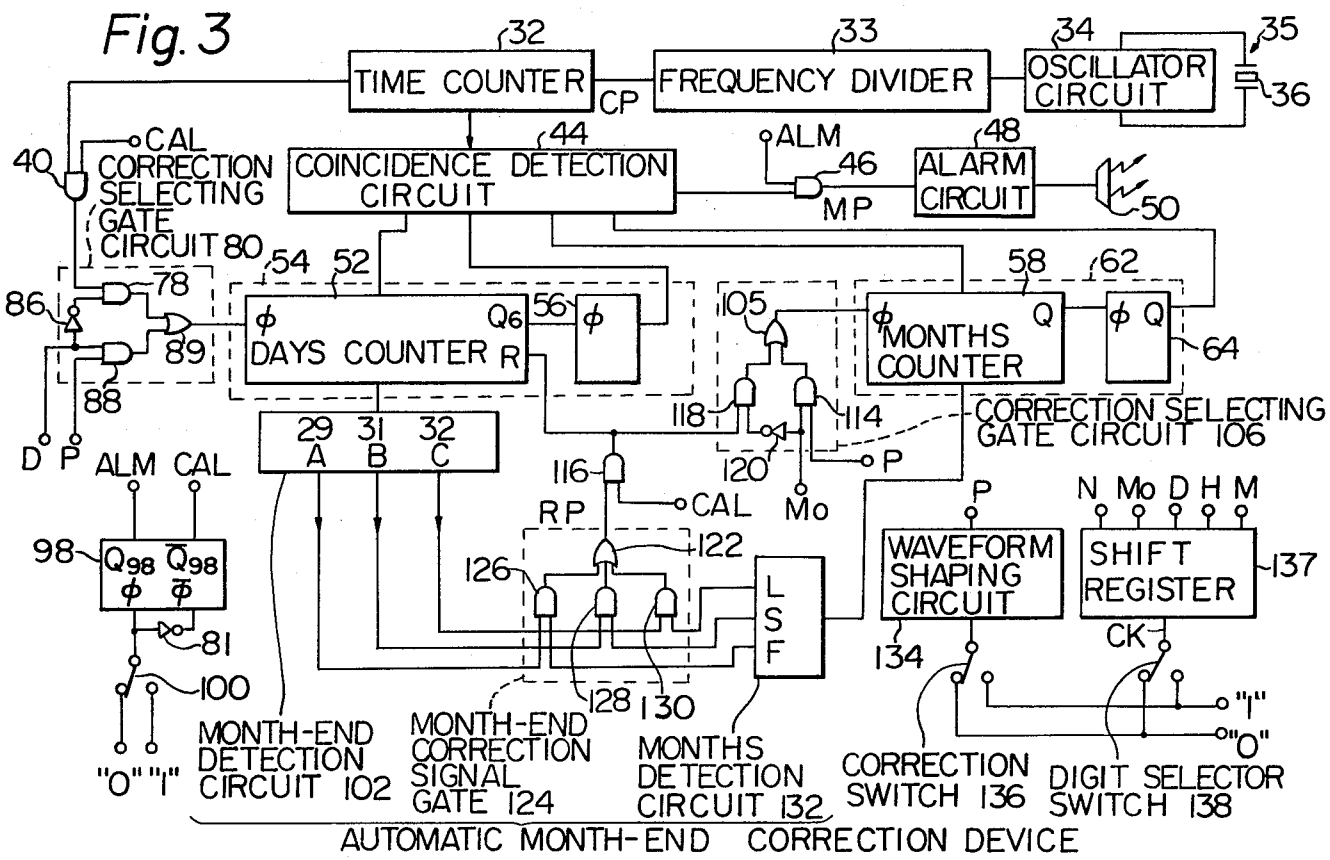
FIG. 3 is a block diagram of circuitry for an embodiment of a watch of the present invention.

In FIG. 3, a FF 98 is utilized for function selection. FF 98 is controlled by function selector switch 100, and generates an alarm function designating signal ALM when output terminal $Q_{98}$ is at the logic "1" level and a calendar function designating signal CAL when output $\overline{Q_{98}}$ is at the logic level "1". Numeral 81 indicates an inverter.

A shift register 137 is used to select digits to be corrected. Application of successive input pulses to clock terminal CK from a digit selector switch 138, which is controlled by digit selector button 22, causes an output signal to appear on successive output terminals of the shift register 137 in cyclical fashion. Thus, a normal display designating signal N, a months correction designating signal Mo, a days correction designating signal D, an hours correction designating signal H and a minutes correction designating signal M can be generated as required.

Numeral 134 indicates a waveform shaping circuit, which generates a correction pulses P for each actuation of correction switch 136, controlled by correction button 24.

A correction selecting gate circuit 80 is connected between AND gate 40 and days counter 52, and is used to select the input signal to be applied to the days counter 52. Gate circuit 80 comprises AND gates 78 and 88, an OR gate 89 and an inverter 86. While the days correction designating signal D from shift register 137 is not generated, the carry signal from time counter 32 passes through AND gate 78 and the OR gate 89 to be applied to input terminal of the days counter 52. When the days correction designating signal D is generated, correction pulses P from the waveform shaping circuit 134 pass through AND gate 88 and OR gate 89, thereby correcting the days counter 52.

Functioning in similar fashion, correction selecting gate circuit 106 is used to select the input signal to be applied to the months counter 58. Gate circuit 106 comprises AND gates 118 and 114, an OR gate 105 and an inverter 120. It selects either the carry output from the days counter 52 or the correction signal P, in dependence on the level of the months correction designating signal Mo applied to a control terminal.

Indicated as 102 is a month-end detection circuit, which receives the output of the days counter 52 as input and produces output signals corresponding to a count of either 29,31 or 32 days at output terminals A, B and C, respectively. A months detection circuit 132 is connected to the months counter 58, to receive the output therefrom as input and produce a signal thereby on one of three output terminals. An output signal on terminal L designates an odd-numbered month, on terminal S designates an even-numbered month, and on output F designates February.

A month-end correction signal gate 124 is connected between month-end detection circuit 102 and months detection circuit 132, and is composed of AND gates 126, 128 and 130 and an OR gate 122. The month-end correction signal gate 124, in combination with the month-end detection circuit 102 and the months detection circuit 132 constitutes an automatic month-end correction device for the calendar function. This generates a month-end automatic correction signal RP on the last day of each month, which resets the days counter 52 to the first day condition, and also is applied as a carry input signal to the months counter 58.

The AND gate designated as 116 operates to inhibit application of the automatic correction signal RP when the alarm function has been selected.

When FF 98 is in the condition of producing the calendar function designating signal CAL and shift register 137 is generating the normal display designating signal N, then both the carry inhibit AND gates 40 and 116 are in the "on" state, so that they permit the carry signals applied to them to pass. In addition, any signals produced by the correction selecting gates 80 and 106 are applied to the respective control terminals. Since the carry signals are, as stated, permitted to pass, a serial counter chain consisting of the time counter 32, the days counter 52 and the months counter 58 is established. The days counter 52 is advanced by the carry output from the time counter 32. Now, if the content of the months counter corresponds to February, then the months detection circuit 132 will generate an output signal on terminal F. This causes an output signal to be generated at output terminal A of the month-end detection circuit 102 when the days counter 52 reaches a count of 29. The month-end automatic correction signal RP the passes through AND gate 126 and OR gate 122 and resets the days counter 52 to a count of one, corresponding to the first day of the following month. At the same time, signal RP passes through the correction selecting gate 106 and advances the months counter 58 by one, thereby completing the automatic month-end correction. Similarly, if the contents of the months counter 58 correspond to a month with an even number of days, then an output signal appears on designating terminal S of the months detecting circuit 132. Accordingly, when the 31st day is counted, an output signal appears on the output terminal of the month-end detection circuit 102, which passes through AND gate 128 and OR gate 122 to perform the month-end automatic correction.

In the case of an odd-numbered month, then month-end correction is performed when a count of 32 days occurs.

To perform a correction of the contents of the months counter 58 to any desired figure, the wearer first depresses the digit selection button 22 once, to bring shift register 137 into the months correction designating state by generating the months correction designating signal Mo. This causes the correction selecting gate 106 to be brought into the correction signal selection state, and the wearer then actuates the correction button 24 a sufficient number of times to perform the necessary correction. In a similar way, correction of the contents of the days counter can be performed by bringing the shift register 137 into the days correction designating state to set the correction selecting gate 88 into the days correction designating condition, and then actuating the correction button 24 the number of times required to carry out the necessary correction.

After the required correction has been performed, the digit selection button 22 can be actuated so as to bring register 137 back into the normal display designating state.

A description will now be given of operation when the alarm function is selected. Setting the function selection member 26 to the alarm position causes FF 98 to produce an alarm designating signal ALM. This causes AND gates 40 and 116 to go to the "off" state and AND gate 46 to the "on" state, thereby inhibiting the passage of carry signals to the counters to which they are connected, the serial time counter being devided in two by the operation of gate 40 connected between time counter 32 and days counter 52. The carry signal from the days counter 52 to the months counter 58 is also inhibited by gate 116, and operation of the month-end automatic correction circuit is interrupted. FF 56 is connected in series with days counter 52, to form the minutes memory counter 54. Also, FF 64 is connected in series with months counter 58 to form the hours memory counter 62.

Setting in an alarm time to these memory counters is performed in similar fashion to the process of month and days correction when the calendar function is selected. This means that, to set the minutes of an alarm time into the minutes memory counter 54 a days correction designating state is attained by actuation of digit selecting button 22. Correcting button 24 can then be actuated to write in the required number of minutes. Similarly, to write in the hours of an alarm time, the months correction procedure is employed. Thus, the same means which are utilized for correction purposes with the timepiece in the calendar function condition are also used to write in alarm time data when the alarm function is selected.

Figures 4A, 4C:
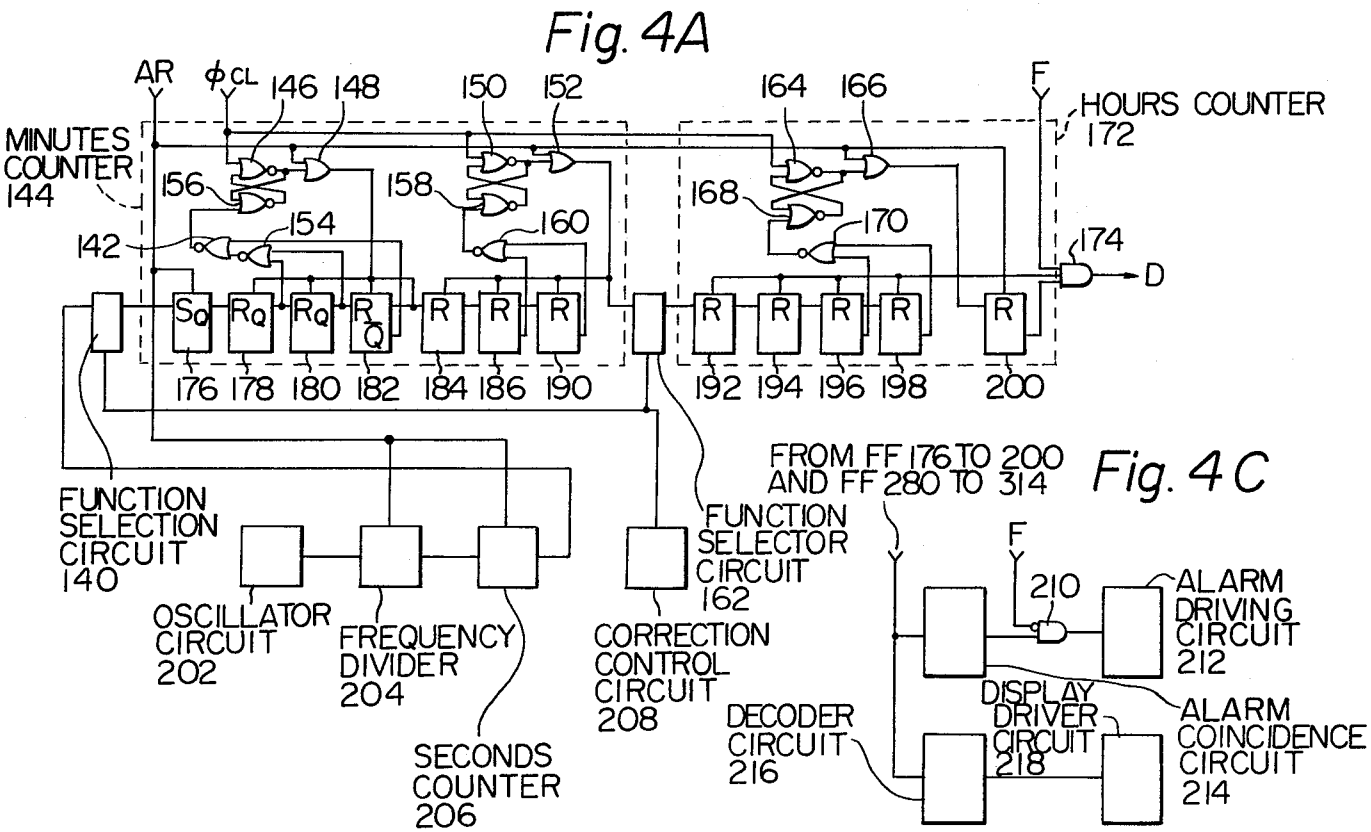
FIGS. 4A, 4B and 4C are partial wiring diagrams for an embodiment of the circuitry of FIG. 3.
Figure 4B:
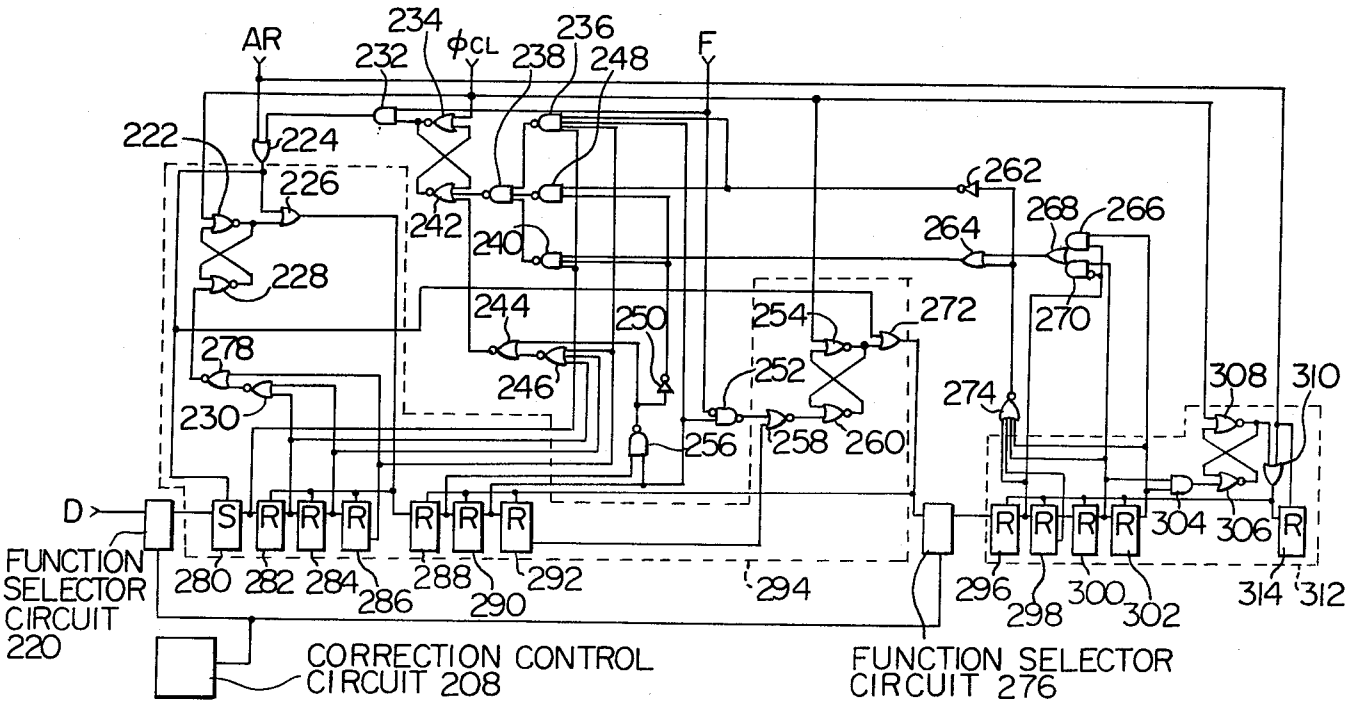

FIGS. 4A and 4B illustrate another example of circuitry for a timepiece in accordance with the present invention. The manner in which this invention permits testing of the timepiece functions to be simplified will be explained with reference to this example.

By resetting the counter circuits of the timepiece while one function, for example an alarm function, is selected, then the alarm function can quickly be tested, since the resetting causes coincidence to be established between the contents of the time counter and the alarm memory counter. In conventional timepieces, when resetting of the minutes is performed, the count is reset to 00. However, since in this invention the minutes data is reset to 01, it is possible to test other functions such as a calendar function where the date is reset to "day 1". A days display of 00 is prohibited by the timepiece circuitry, since the first day of each month is displayed as 01.

An explanation will now be given of the example of the invention shown in FIGS. 4A and 4B.

In FIG. 4A, numeral 202 indicates a circuit block containing a reference oscillator circuit. 204 shows a frequency divider, with an output frequency of one cycle per second. A seconds counter shown at 206 divides the frequency of the 1 Hz signal from the frequency divider 204 by 1/60 to produce a signal of one minute period. Reset terminal AR is connected to the frequency divider 204 and the seconds counter 206, this terminal being used to reset the flip-flops of these counters. Function selector circuits are shown at 140 and 162, these circuits being controlled by correction control circuit 208, so that a correction signal is transferred when so required. The construction of the above-mentioned circuits is as normally employed in timepieces, and further explanation is therefore omitted.

A decimal counter circuit for minutes counter 144 is constituted by flip-flops 176 to 182 and gates 142, 146, 148, 154 and 156. NOR gates 154 and 142 detect the states of flip-flops 176 to 182, and the output of gate 142 goes to the "H" logic level when the count exeeeds ten, causing a reset signal to be produced by the latch circuit made up of gates 156 and 146. This reset signal passes through gate 148 to reset flip-flops 178 to 182. Since at this time the Q output of FF 176 is already at the "L" logic level, the decimal counter is reset to the zero state. Thus the count sequence proceeds as 0, 1, . . . 9,0,1, . . . etc. Flip-flops 184 to 190 and gates 150, 152, 158 and 160 constitute a divide-by-six counter of the minutes counter 144. The input to this counter is the reset signal from gate 148 connected to reset terminal AR. Counts of six or more for the counter consisting of flip-flops 184 to 190 are detected by NOR gate 160 and a reset signal is produced by the latch circuit consisting of gate circuits 150 and 158, as for the decimal counter circuit. The reset signal passes through OR gate 152 to reset flip-flops 184 to 190 and return the count to 0.

Flip-flops 192 to 198 and gates 164, 166, 168 and 170 constitute a divide-by-twelve hours counting circuit 172. The reset signal from gate 152 passes through selector circuit 162 and is applied as a clock input to FF 192. Flip-flop 200 of hours counter circuit 172 halves the frequency of the reset signal from the divide-by-twelve counter output of gate 166, so that the divide-by-twelve counter is extended to a count capability of 24. The output signal therefrom passes through gate 174 to produce a days signal, D. $\phi_{CL}$ is a latch strobe signal, which resets the latch circuits made up of gates 146 and 156, 150 and 158, 164 and 168, so as to define the widths of the reset signals produced by these latches.

F indicates a function selector terminal, whose "H" and "L" logic levels are determined by an external actuating member. Selection is performed between the calendar and the alarm functions when the levels of this terminal are at the "H" or "L" logic levels, respectively. AR indicates a reset terminal. Application of an "H" logic level to this terminal causes flip-flop 176 to be set and flip-flops 178 to 200 to be reset through gates 148, 152 and 166. This results in a time display of 12:01 AM.

FIG. 4B is a circuit diagram showing the main portions of circuits which perform alarm memory and calendar functions in an electronic timepiece of the present invention which incorporates an alarm memory. Numbers and symbols indentical with those of FIG. 4A represent identical components or signals.

Numerals 220 and 276 indicate function selector circuits. As in FIG. 4A, control circuit 208 permits input to the counter stages of either a carry signal from a preceding counter or alarm time setting and time correction signals. The decimal counter for days counting is constituted by flip-flops 280 to 286 and gates 222, 226, 228, 230 and 278. When reset is performed, by applying an "H" logic level signal to the AR terminal, then the Q output of FF 280 is set to the "H" level.

Counting of tens of days is performed by flip-flops 288 to 292 and gates 254, 258, 260 and 272. This circuit, which has a maximum count of 40 in the days counting application, is extended to count to 60 by the operation of gate 252 in the alarm memory condition, when the function selection terminal is at the "L" logic level.

Months counting is performed by a divide-by twelve counter made up of flip-flops 296 to 302 and gates 304, 306, 308 and 310. This circuit is also used to store the hours of alarm time data when the alarm function is selected, with FF 314 being added as a counter stage in this case. When function selection terminal F is at the "H" logic level, then automatic month-end correction is performed by means of gates 224, 250, 262, 266, 268 and 270. These circuits serve to discriminate between months containing odd and even numbers of days, with the count of flip-flops 280 to 292 varying from 28 to 31 in accordance with the particular month. A days signal D is supplied as a clock input when the function selector terminal F is at the "H" logic level.

When a reset signal is applied from reset terminal AR, with the function selector terminal F at the "L" logic level, (alarm function), an alarm time of 12:01 AM is displayed. For an "H" logic level of terminal F, (calendar function), a date of 12. 1 (i.e. December 1st) is displayed.

FIG. 4C is a block diagram illustrating an example of an output section for an electronic timepiece of the present invention.

Numeral 214 indicates an alarm coincidence circuit and 212 shows a logic gate. When terminal F is set to the "L" logic level, (alarm function), then when alarm coincidence occurs a signal is sent from circuit 214 to alarm driving circuit 212, thereby generating an audible alarm. Numerals 216 and 218 indicate a decoder circuit and a display driver circuit respectively used to convert the Q output signals from flip-flops 176 to 200 in FIG. 4A and flip-flops 280 to 314 in FIG. 4B to seven-segment display numerals. Numeral 218 indicates a display mechanism which produces a digital display under the control of signals from the decoder and driver circuits 216. Alarm coincidence circuit 214 performs exclusive OR logic comparisons between the outputs of flip-flops 176 to 200 in FIG. 4A and the outputs of flip-flops 280 to 314 in FIG. 4B respectively, and then generates the logic sum of the outputs from the exclusive OR comparisons.

Figures 5, 5A, 5B:
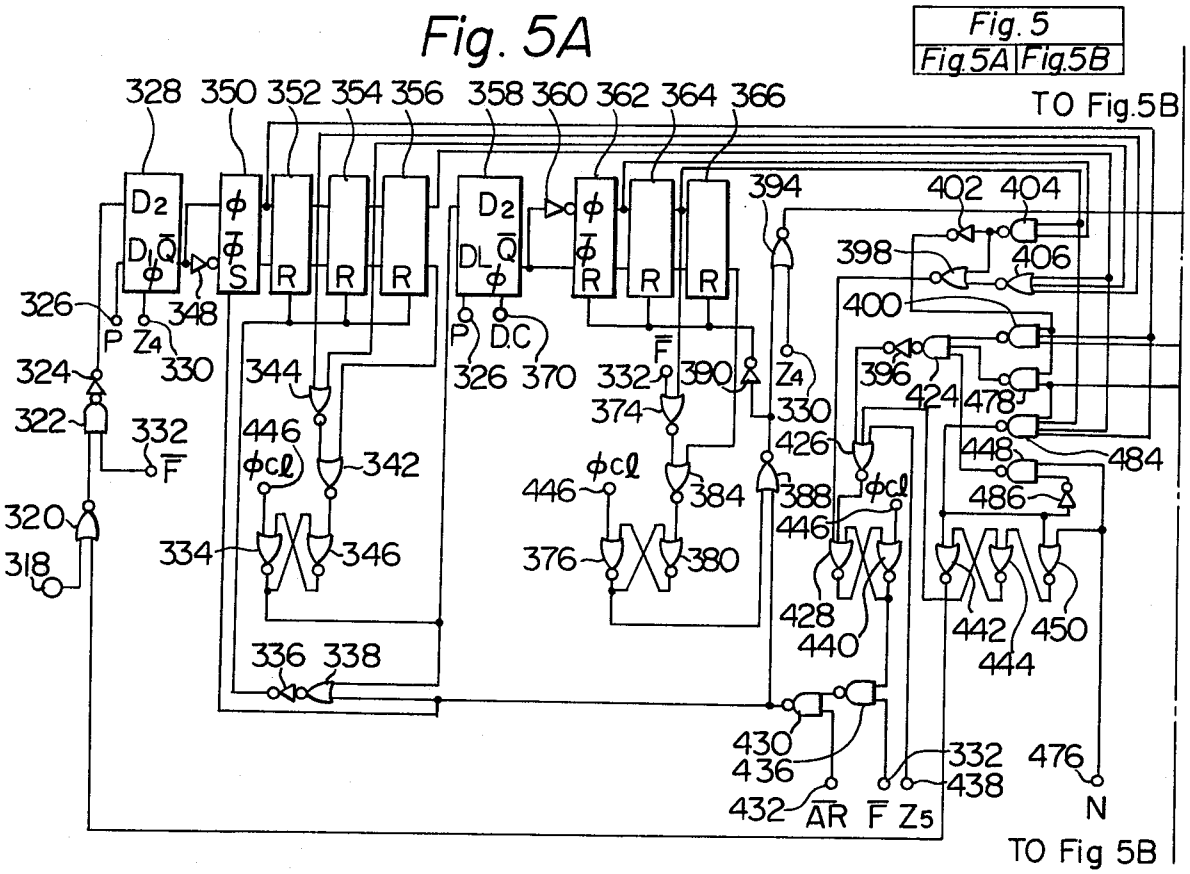
FIGS. 5A and 5B show a detailed wiring diagram of calendar computation and additional function circuits for a watch of the present invention.
Figure 5B:
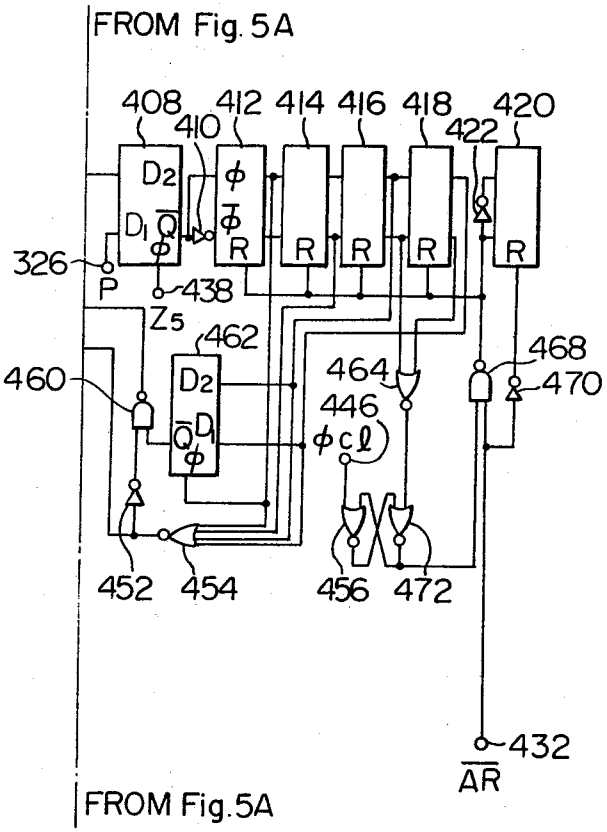

FIGS. 5 and 5B is a detailed circuit diagram of an example of function circuits for a timepiece of the present invention. Numeral 318 indicates an input signal terminal, 328 and 408 indicate selector circuits composed of gates, and numerals 350 to 366 and 408 to 420 indicate flip-flops constituting two frequency counter chains. Numeral 432, designated $\overline{AR}$, indicates a terminal to which counter reset signals can be applied. Numeral 332, $\overline{F}$, indicates a control terminal used for function selection. 446 shows a reference signal input, $\phi_{CL}$ and 326 indicates a terminal, P, used to input correction and alarm time setting pulses. Numeral 330 indicates terminal $Z_4$, which control selector circuit 328. Numeral 438 shows terminal $Z_5$ which controls selector circuit 408, and 370 indicates terminal DC, which controls selector circuit 358. Numeral 476 indicates terminal N, which controls selection of the normal display or correction modes of operation of the timepiece. Like signal terminals are denoted by like numerals throughout the diagram.

The operation of the circuit is as follows. An input time signal of one pulse per day, produced from the time counting section of the timepiece (omitted from this description) is applied to terminal 318. These pulses are blocked from passing through gate 322 when calendar correction is being performed. Passage of these pulses can also be inhibited by gates 322 and 324, which is the case during alarm function operation. The input to either terminal D1 or D2 of selector circuit 328 is selected for output by control of terminal $\phi$ of 328, this output appearing on the $\overline{Q}$ terminal. This follows the logic equation:

$$\overline{Q} = \overline{D_1\phi + D_2\overline{\phi}}$$

Each of the flip-flops 350 to 356, constituting the first counter, has input terminals $\phi$ and $\overline{\phi}$, and is of the negative-edge triggered type, i.e. when the signal applied to the $\phi$ terminal changes from 1 to 0, the state of the Q and $\overline{Q}$ outputs changes. Flip-flops 350 to 356 are connected in series, and a latch circuit consisting of gates 334 and 346 is triggered when the counter contents, as monitored by gates 344 and 342, reach 10 or more. A reset pulse is thereby generated which transmits a carry pulse to succeeding counter chain as well as resetting flip-flops 350 to 356.

It is a feature of this invention that the flip-flops of the counters immediately and without fail go to valid count states immediately after power is first applied to the circuits. This means that numerals of 0 to 9 will be immediately displayed for corresponding counter contents of 0 to 9, and that reset to zero occurs for counter values between 10 to 15, in the case of the counter composed of flip-flops 350 to 356.

The output from gate 342 is given by the logic equation:

$$\text{Gate } 342 = \overline{\overline{Q_{352} + Q_{354} + Q_{356}}},$$

which simplifies to $$= (Q_{352} + Q_{354}) \cdot (Q_{356})$$

$$= Q_{352} \cdot Q_{366} + Q_{354} \cdot Q_{356}$$

and the condition for the output to attain the "1" level is:

$$= (10 + 11) + (12 + 13 + 14 + 15)$$

Thus when the contents of the counter chain FF 350 to 356 is 10 or more, an output signal of logic level "1" is generated by gate 342, triggering the latch circuit composed of gates 334 and 346 and producing a reset pulse. This pulse is applied to FF 352 to 356, resetting them, and is normally generated once every tenth day.

The operation of the latch composed of gates 334 and 346 is as follows. NOR gates 334 and 346 are connected such that the output of one gate is connected to one of two inputs of the other gate. In addition, in the present embodiment, an input is applied to the second input of gate 334 consisting of reference signal $\phi_{CL}$. The output of gate 342 is connected to the second input terminal of gate 346. When the output from gate 342 is a logic level "0", the output of gate 334 is held at the "0" level by the "1" level of signal $\phi_{CL}$. Accordingly the counter of FF 352 to 356 continuously counts. When a count of 10 or more is reached, the output of gate 342 goes to the logic level "1". The output of gate 346 therefore goes to "0", as long as the $\phi_{CL}$ signal is at the "0" level, thereby generating a "1" level signal from gate 334. This signal resets FF 352 to 356 and accordingly brings the output of gate 342 to "0". When the $\phi_{CL}$ signal subsequently goes to the "1" level, this causes the output of gate 334 to return to the "0" level. An automatic reset means is thus provided which is equivalent in functioning to an R-S flip-flop.

The counters of the function circuit of this embodiment are as follows: a decimal counter with a maximum count of 9, a divide-by-six counter with a maximum count of 5 and a divide-by-twelve counter with a maximum count of 11. These are all designed such that each counter is immediately reset to an initial predetermined count by application of a reset pulse. Reliable operation is assured since the width of the reset pulse is determined by the reference signal $\phi_{CL}$.

The preceding description of the operation of the decimal counter also applies to the divide-by-six and divide-by-twelve counters. FF 362 to 366 and gates 374, 376, 388, 384 constitute the divided-by-six counter. FF 412 to 418 and gates 456, 464, 468 and 472 constitute the divide-by-twelve counter.

A description is given hereunder of operation when the calendar function is selected. Calendar function selection is performed by setting external control terminal $\overline{F}$ (numeral 332) to the "1" logic level. The signal from this terminal controls gates 322, 374 and 436. Pulses are sent at the rate of one per day from gate 320 through gate 322 to be described hereunder. When the contents of the counter constituted by FF 362 to 366 reaches 4 or more, gate 374 is caused to produce a reset pulse due to the "1" level of the $\overline{F}$ signal input to it. This is necessary since a days count of 40 or more is not valid. Gate 436 produces a month-end correction signal, in a manner to be described hereunder, when terminal $\overline{F}$ is at the "1" level.

The number of days in each calendar month are:

January — 31 days; February — 28 or 29 days; March — 31 days; April — 30 days; May — 31 days; June — 30 days; July — 31 days; August — 31 days; September — 30 days; October — 31 days; November — 30 days; and December — 31 days.

The months of 31 days, namely January, March, May, July, August, October and December are referred to herein as odd-numbered months. February, April, June, September and November are referred to as even-numbered months. The counting circuits of this embodiment are controlled by an even-numbered month detection block and by a block which detects days of 32 or more as well as 31st, 30th and 29th days. The even-numbered month detection block, taking the output of the section which detects April, June, September and November, and the output of the section which detects February, namely gate 454, produces the logic sum of these outputs by means of gate 460. The logic equation for the selector circuit 462 is:

$$\overline{Q} = \overline{D_1\phi + D_2\overline{\phi}}$$

and therefore with the output of FF 418 applied to the input of this circuit and the outputs of FF 416 and FF 412 applied to terminals $D_2$ and $\phi$, respectively, then the above equation becomes:

$$\overline{Q} = \overline{FF\,418 \cdot FF\,412 + FF\,416 \cdot \overline{FF\,412}}$$

$$= \overline{(8 \text{ or more}) \cdot (\text{odd number}) + (4,5,6,7) \cdot (\text{even number})}$$

$$= \overline{[9.11] + [4.6]}\text{, solving for "0"}$$

solving for "0"

Accordingly the output of selector circuit 462 reaches the "0" level for the months of April, June, September and November.

However, since the input signals to gate 454 are applied from FF 412, $\overline{\text{FF}}$ 414, FF 416, and FF 418, the equation for gate 454 has the form:

$$\text{Gate } 454 = \overline{FF\,412 + \overline{FF\,414} + FF\,416 + FF\,418}$$

Thus, February is detected when gate 454 has a "1" level output, i.e. when $FF\,412 = 0$, $FF\,414 =$ "1", $FF\,416 =$ "0" and $FF\,418 =$ "0". Thus, detection of even-numbered months is performed by gate 460. The equation for gate 460 is $$\text{Gate } 460 = \overline{\overline{\text{change-over of } 462} \cdot \text{gate } 452}$$

$$= \overline{\overline{\text{change-over of } 462} \cdot \text{gate } 454}$$

$$= \text{change-over of } 462 + \text{gate } 454$$

-continued $$= 2,4,6,9 \text{ and } 11.$$

The detection block consisting of gates 428 and 440, 442 and 444, 450, 486, 448 and 484 will now be described. Detection is performed by the operation of gates 404, 406 and 398, and is carried out by detecting the logic sum of a 30th day detection section output and a section which detects numbers in excess of 2. The logic equation for gate 398 is:

$$\text{Gate } 398 = \overline{\text{Gate } 404 + \text{Gate } 406}$$

$$= \overline{\overline{FF\,362 \cdot FF\,364} + \overline{FF\,352 + FF\,354 + FF\,356}}$$

$$= [FF\,362 \cdot FF\,364] \cdot [FF\,352 + FF\,354 + FF\,356]$$

$$= [FF\,362 = \text{"1"} \cdot FF\,364 = \text{"1"}] \cdot [FF\,352 + FF\,354 + FF\,356]$$

$$= [30] \cdot [2,3,4,5,6,7,8,9]$$

$$= 32 \sim 39$$

Operation of the detection block for the 31st day is as follows. For even-numbered months, a month-end correction is performed by generating the logic product of the even-numbered months detection signal and the 31st day detection signal. Thus, a 31st day signal for even-numbered months is produced by gates 404, 402, and 400. The logic equation for gate 400 output is:

$$\text{Gate } 400$$

$$= \overline{\text{Gate } 402 \cdot FF\,350 \cdot \text{Gate } 460}$$

$$= \overline{\overline{\text{Gate } 404} \cdot FF\,350 \cdot \text{Gate } 460}$$

$$= \overline{FF\,362 \cdot FF\,364 \cdot FF\,350 \cdot (\text{even-numbered month})}$$

$$= \overline{(30) \cdot (1) \cdot \text{even-numbered month}}$$

$$= \overline{(31) \cdot (\text{even-numbered month})}$$

Since there is no 30th day in February, the counters must be reset immediately such a condition is detected. This detection is performed by gate 478, whose logic equation is:

$$\text{Gate } 478 = \overline{\text{Gate } 402 \cdot \text{Gate } 454}$$

$$= \overline{(30\text{th day}) \cdot (\text{Feb})}$$

In the present embodiment, a month-end correction normally takes place following the 28th day of February. However provision is made such that the timepiece may be adjusted for a count of the 29th day of February, whereupon month-end correction will take place following the 29th of February. A section is therefore incorporated to detect the 29th day of February, together with associated memory circuits. This functions as follows.

Detection of the 29th day of February is performed by gate 484, whose logic equation is:

$$\text{Gate } 484 = \overline{\text{Gate } 454 \cdot FF\,364 \cdot FF\,350 \cdot FF\,356}$$

$$= \overline{(\text{Feb}) \cdot (20\text{th day}) \cdot (9\text{th day})}$$

-continued $$= \overline{(\text{Feb}) \cdot (29\text{th day})}$$

Normally, the detection signal for the 29th day of February, generated by gate 484, passes through gates 486 and 488 to trigger the latch composed of gates 428 and 440, via gates 424, 426 and 396. A month-end correction is thereby performed. During a time setting procedure, however, this signal is inhibited by gate 448, since terminal N, connected to one input of this gate, is at the "0" level. However, the latch circuit composed of gates 442 and 444 is actuated, due to the "1" level at the input terminal of gate 442. The output of gate 442 controls gate 320, so that the input signal applied to terminal 318 is inhibited and therefore counting cannot take place.

For the case in which a month and date other than the 29th of February are set in by the correction means, the latch circuits of gates 442, and 444 is reset when the correction operation is completed, at which time terminal N is returned to the "1" level. This means that a count of calendar correction pulses is performed through and including the 29th of February. To sum up:

(1) A month-end correction is performed for day counts of 32 or more.

(2) The 32nd day of odd-numbered months and the 31st day of even-numbered months are detected, and reset performed to the first day of the following month.

(3) A month-end correction is performed for the 30th day of February.

(4) Normally, the day following the 28th of February is reset to March 1st. However, when time setting is performed, this reset is inhibited and it is possible to set a date of the 29th of February.

Month-end correction is performed as follows: When a signal indicating a 32nd or any subsequent day is generated, or a signal indicating the 31st day of an even-numbered month, the 30th day of February or the 29th day of February is generated, a latch circuit composed of gates 428 and 440 is triggered. A single pulse is thereby generated by gate 440. This pulse sets FF 350 via gates 436 and 430, and resets FF 352, to FF 356 via gates 338 and 336. At the same time, FF 362 to FF 366 are reset via gates 388 and 390. The reset pulse also passes through gate 394 and selector circuit 408, to advance the contents of the months counter by one. Thus, the days counter is reset to the first day, and the months counter to the following month, i.e. resetting is performed to the first day of the next month.

Time setting is performed as follows, to carry out a calendar correction. If the days data is to be corrected, then selector circuit 328 is actuated by applying a "1" level signal to the Z4 terminal (330). Correction pulses are then applied to terminal 326 and are passed through selector circuit 328 to be input to the days counter. Thus, a number of pulses corresponding to the days correction required are applied to terminal 326. Terminal Z4 is connected to one input of gate 394. Since Z4 is at level "1" during calendar correction, the output of gate 394 is clamped at a fixed level, and no input pulses are applied to the months counter. This ensures that:

(1) The months data is unaffected while the days data is being corrected.

(2) A month-end correction is performed while the days data is being corrected, depending upon the contents of the months counter. However no months counting operation takes place.

For the case in which the months data is to be corrected, selector circuit 408 is actuated by setting terminal Z5 (438) to the "1" level. Correction pulses applied to terminal 326 then pass through selector circuit 408 to the month counter. Thus, by applying a suitable number of correction pulses, any desired month may be input. Since terminal Z5 is also connected to an input of gate 426, actuation of the latch circuit composed of gates 428 and 440 is inhibited while the months data is being corrected. Thus:

(1) The stored days data is not affected while the months data is being corrected.

(2) No month-end correction is performed while the months data is being corrected.

It is, therefore, possible for example to set in a date of April 31st. However, after the setting process has been completed and the timepiece returned to the normal display condition, the end-of-month state will be detected and the date reset to the first day of the following month. For the case of April 31st being set in, a date of May 1st would be displayed upon return to normal display condition, i.e. when Z4 and Z5 return to "0".

If a comparison is made between the inputs to the first stage of the units-of-days counter, FF 350 to FF 356, and the input to the first stage of the tens-of-days counter FF 362 to FF 366, it will be seen that they are inversely related. This is to ensure that month-end correction is reliably performed. When no signal is input to FF 350, its $\phi$ terminal is held at the "1" level, and counting begins on the positive-going edge of an input "one day" pulse or a correction pulse P. However, the identical terminal of FF 362 is held at the "0" level in the absence of an input signal and does not respond to the positive-going edge when an input signal arrives. Counting begins, in this case, when the input signal changes from "1" to "0". This is significant for the following reasons. When the contents of the days counter FF 350 to FF 366 changes from 29 to 30, the speed of operation of various gates will differ. As a result, spurious noise pulses may be generated which can cause unreliable counting to occur. The present embodiment is such that counters FF 350 to FF 356 and FF 362 to FF 366 are operated with a signal delay between the operation of each, which ensures correct counting to proceed.

To summarize the above description, the main advantages are as follows:

(1) Individual counter block do not enter non-valid count states.

(2) The days counters never enter a state corresponding to a non-existant day.

(3) Resetting is automatically performed to the first day of the following month, in accordance with whether the month is odd or even-numbered.

(4) The date may be set by the wearer to the 29th of February, and calendar counting will be normally stopped thereafter.

A description will now be given of the alarm function operation in this embodiment of the invention.

For the alarm function, AM/PM, hours and minutes counters are established by using the various frequency divider blocks as a divide-by-10 counter, a divide-by-six counter, a divide-by-12 counter and a divide-by-2 counter. The alarm memory counters must meet the following requirements:

(1) It must have storage capacity for AM/PM, hours and minutes data.

(2) The contents must be retained until resetting is performed.

To fulfil these conditions, two additional counter stages are added and the input signal of one pulse per day is inhibited when the function counters are used as alarm memory counters. Accordingly, when terminal $\overline{F}$ (332) is at the "0" level, gate 322 is inhibited. Thus the pulses at a rate of one per day are blocked by gate 322 and do not reach FF 350. Also, since terminal $\overline{F}$ is connected to an input of gate 374, the output of gate 384 is given by the logic equation:

$$\text{Gate } 384 = \overline{\text{Gate } 374 + \overline{FF\,366}}$$

$$= \overline{\overline{F} + FF\,364 + FF\,366}$$

$$= FF\,364 \cdot FF\,366$$

$$= 6$$

Thus, FF 362 to FF 366 form a divide-by-six counter, and in combination with FF 350 to FF 356 a memory counter with count capability to 60 is established. Since terminal $\overline{F}$ is connected to gate 436, the month-end correction signal (described hereinabove for the calendar function) is inhibited. Both the hours and minutes memory counters must of course be capable of counts between 0 and 59.

FF 420 is added as a divide-by-2 counter to store AM/PM data. Thus the alarm memory can be set for AM/PM, hours, minutes, to the nearest minute.

The design of this embodiment is such that the IC utilized for the circuitry can be easily and quickly tested. Applying pulses to terminal P (326) with terminal Z4, DC and Z5 at the "1" level causes FF 350 to FF 356, FF 362 to FF 366 and FF 412 to FF 420 to begin counting simultaneously. This makes it possible to complete testing of the IC in an extremely short period of time. A minimum of 24 pulses causes the contents of FF 350 to FF 420 to undergo a complete change of count state, thereby effectively testing these flip-flops. In a conventional electronic digital timepiece, a minimum of $10 \times 6 \times 12 \times 2$, i.e. 1,440 pulses would be required to perform the same test.

Figure 6A:
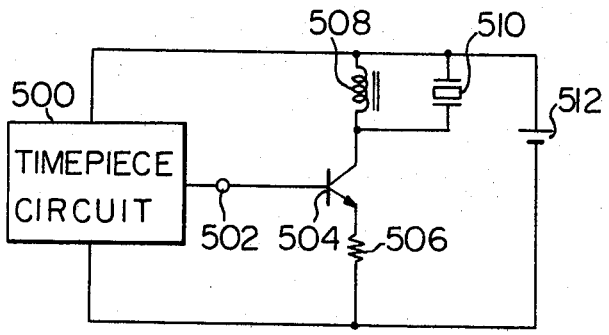
FIG. 6A is a circuit diagram for an improved circuit to operate an alarm buzzer in a watch built in accordance with the present invention.

FIG. 6A shows the circuit diagram of an improved driver circuit suitable for driving a piezo-electric buzzer to give alarm warning in a timepiece of the present invention. Conventional buzzer driving circuits can cause transient surges of current to be drawn from the battery supplying the timepiece, thereby adversely affecting timekeeping accuracy. This improved buzzer driving circuit is designed to overcome this problem.

Referring to FIG. 6A, numeral 500 indicates the circuitry of the timepiece other than the alarm drive circuit. This watch circuitry supplies an alarm actuating signal to the buzzer driver circuit, which is applied to the base of a transistor 504, in which the signal is amplified. Current flowing in the transistor thereby causes electromagnetic energy to be stored in the flyback coil 508. When transistor 504 is cut-off, then the energy stored in the flyback coil 508 causes a high voltage to be developed across the coil, thereby driving the piezo-electric element 510. This element is attached to a vibrator plate, and so periodic actuation of the piezo-electric element produces an audible buzzing sound.

Figure 6B:
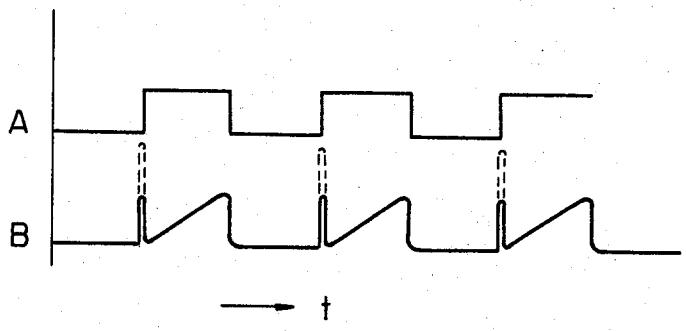
FIG. 6B shows operating waveforms for the circuit of FIG. 6A.

A waveform diagram for the present embodiment of the driver circuit is shown in FIG. 6B. It can be seen from B that a large current flows through the transistor for a very short period of time after the input signal rises from the "0" to the "1" level. This current flows through the transistor 504, which has a very low resistance in the "on" state, via the piezo-electric element. This current surge may cause the battery voltage to fluctuate, which can have serious effects upon the timekeeping accuracy. It is a feature of this invention that a current-limiting resistor 506 is inserted in series with the transistor, such that the maximum current surge can be limited in amplitude. In addition to ensuring that timekeeping accuracy is preserved, this feature serves to lower power consumption of the buzzer driving circuit. Moreover, the action of the resistor in the emitter lead of the transistor leads to a current negative feedback effect, which increases operating stability and raises the input impedance to the circuit.

What is claimed is:

1. An electronic timepiece comprising:

a frequency standard;

a frequency divider which divides an output frequency of said frequency standard to provide output pulse signals;

a time counter driven by said output pulse signals to provide time information signals;

counter means coupled to said time counter to form a serial counter chain and operative to function in one of first and second modes;

circuit means connected between said time counter and said counter means for permitting transfer of said time information signals to said counter means whereby said counter means operates in said first mode for producing a first data signal, said circuit means including means for interrupting the transfer of said time information signals to said counter means and permitting entry of input signals other than said time information signals into said counter means whereby said counter means operates in said second mode for producing a second data signal other than said first data signal;

means for producing said input signals;

means for controlling said circuit means to cause said counter means to operate in one of said first and second modes; and means for providing a display of said time information signals, first data signal and said second data signal.

2. An electronic timepiece according to claim 1, in which said control means comprises a control terminal by which said one of first and second modes is fixedly set.

3. An electronic timepiece according to claim 1, in which said counter means constitutes part of said time counter.

4. An electronic timepiece according to claim 3, in which said counter means comprises a days counter and a months counter, and in which said first data signal is a calendar data signal and said second data signal is an alarm data signal.

5. An electronic timepiece comprising:

a frequency standard;

a frequency divider which divides an output frequency of the frequency standard to provide output pulse signals;

a time counter driven by said output pulse signals to provide time information signals in response thereto;

counter means operative to function in first and second modes;

change-over circuit means including first means for interconnecting said counter means with said time counter to pass said time information signals to said counter means by which said counter means operates in said first mode for producing a first data signal, and second means for inhibiting said first means to interrupt said counter means from said time counter, said second means including means for permitting the setting-in of input signals other than said time information signals into said counter means by which said counter means operates in said second mode for storing a second data signal other than said first data signal;

means for producing said input signals;

means for controlling said change-over circuit means to set said counter means in one of said first and second means; and display means for providing a display of said time information signals, said first data signal and said second data signal.

6. An electronic timepiece comprising:

a frequency standard;

a frequency divider which divides an output frequency of the frequency standard to provide output pulse signals;

a time counter driven by said output pulse signals to provide time information signals in response thereto;

counter means operative to function in first and second modes;

change-over circuit means including first means for interconnecting said counter means with said time counter to pass said time information signals to said counter means by which said counter means operates in said first mode for producing a calendar information signal, and second means for inhibiting said first means to interrupt said counter means from said time counter, said second means including means for permitting the setting-in of input signals other than said time information signals into said counter means by which said counter means operates in said second mode for storing data other than said calendar information signal;

means for producing said input signals;

means for controlling said change-over circuit means to set said counter means in one of said first and second modes; and display means for providing a display of said time information signals, said calendar information signal and said data.

7. An electronic timepiece according to claim 6, in which said counter means comprises a days counter, a first flip-flop coupled to an output of said days counter, a months counter, and a second flip-flop coupled to an output of said months counter.

8. An electronic timepiece according to claim 7, in which said days counter and said months counter serve as a minutes memory counter and an hours memory counter, respectively, by which alarm time data can be stored.

9. An electronic timepiece according to claim 8, further comprising a coincidence detection circuit connected to said time counter and said counter means for producing a coincidence signal when said time information signals coincide with said alarm time data, and means for indicating said alarm time data in response to said coincidence signal.

10. In an electronic timepiece having a frequency standard, a frequency divider which divides an output frequency of the frequency standard to provide output pulse signals, a time counter driven by said output pulse signals from said frequency divider, and display means for displaying the contents of said time counter, the improvement comprising:

counter means composed of a days counter and a months counter coupled to said time counter in series to form a serial counter chain and receiving an output signal from said time counter to perform a calendar function and an alarm function; and change-over means disposed in said counter chain between said time counter and said counter means, said change-over means selectively changing over the functions of said counter means;

said counter means including flip-flops which are coupled to outputs of said days counter and said months counter, respectively, by said change-over means whereby said days counter and said months counter may function as a minutes memory counter and an hours memory counter, respectively, in said alarm function.

11. The improvement according to claim 10, in which said counter means is connected to said display means whereby the contents of said counter means can be displayed by said display means.

12. The improvement according to claim 10, in which said change-over means includes a carry inhibiting gate which can be actuated to inhibit the passage of said output signals from said time counter to said counter means.

13. The improvement according to claim 10, in which said display means comprises a current time display station to which said time counter is coupled, and a function display station to which said counter means is coupled, whereby the contents of said memory counters can be displayed by said function display station.

14. The improvement according to claim 10, further comprising a coincidence detecting circuit coupled to said time counter and said memory counters and generating a coincidence signal when a current time stored in said time counter comes into coincidence with an alarm time stored in said memory counters, and alarm means responsive to said coincidence signal to produce an alarm warning therefrom.

15. The improvement according to claim 14, in which said alarm means includes an alarm circuit connected to said detecting circuit to provide an alarm actuating signal in response to said coincidence signal, and an audible alarm unit responsive to said alarm actuating signal for thereby providing an audible alarm signal.

16. The improvement according to claim 15, in which said alarm means further includes means for inhibiting the passage of said alarm coincidence signal to said alarm circuit, thereby stopping the operation of said audible alarm unit.

17. The improvement according to claim 10, further comprising an automatic month-end correction device connected to said counter means for automatically resetting the contents of said counter means to correspond with the first day of the following month immediately after the end of each calendar month.

18. The improvement according to claim 17, in which said month-end correction device comprises a month-end detection circuit connected to said days counter to detect contents of said days counter which correspond to the ends of months and to generate output signals indicative thereof, a months detection circuit connected to said months counter to detect odd-numbered months, even-numbered months and February and generate output signals indicative thereof, a month-end correction signal gate connected to said days counter and said months counter and responsive to the output signals from said month-end detection circuit and said months detection circuit from generating an automatic correction signal by which said days counter is reset to a count of one corresponding to a first day of the following month and said months counter is advanced by a count of one.

19. The improvement according to claim 18, further comprising digit selector switch means, correction switch means, a shift register coupled to said digit selector switch means and generating at least a days correction designating signal and a months correction designating signal when said digit selector switch means is actuated, means for generating correction pulses when said correction switch means is actuated, a first correction selecting gate circuit connected between said change-over means and said days counter and responsive to said days correction designating signal and said correction pulses for correcting said days counter, and a second correction selecting gate circuit connected between said days counter and said months counter and responsive to said months correction designating signal and said correction pulses for correcting said months counter.

20. The improvement according to claim 19, in which said change-over means and said month-end correction signal gate are rendered inoperative in the alarm function, and in which said first and second correction selecting gate circuits serve as means for writing in the minutes and hours of alarm time data in said minutes memory counter and said hours memory counter, respectively, in response to said correction pulses in the alarm function.

21. The improvement according to claim 10, further comprising a reset control terminal coupled to said time counter and said counter means, and in which the application of a reset signal to said reset control terminal causes the contents of said time counter and said counter means to be brought into coincidence with each other.

22. The improvement according to claim 21, in which said time counter comprises a minutes counter and an hours counter, each of said minutes counter and said hours counter comprising a series of flip-flops arranged to perform a counting function, and automatic reset means coupled to said minutes counter and said hours counter.

23. The improvement according to claim 22, in which said automatic reset means comprises count detection means for detecting a maximum count value in said minutes counter and said hours counter, and latch circuit means including a set terminal coupled to receive an output signal from said count detection means and a reset terminal coupled to receive electric pulses at a constant frequency, whereby said latch circuit means is set by an output signal from said count detection means when said maximum count value is exceeded thereby causing a reset signal to be generated by said latch circuit means, said reset signal causing said minutes counter and said hours counter to be reset to the count of zero.

24. The improvement according to claim 22, in which said counter means comprises a days counter and a months counter, each of said days counter and said months counter comprising a series of flip-flops arranged to perform a counting function, and automatic reset means coupled to said days counter and said months counter.

25. The improvement according to claim 24, in which said automatic reset means comprises count detection means for detecting a maximum count value in said days counter and said months counter, and latch circuit means including a set terminal coupled to receive an output signal from said count detection means and a reset terminal coupled to receive electric pulses at a constant frequency.

26. The improvement according to claim 25, in which a first stage of each series of flip-flops of said minutes counter and said days counter has a set terminal coupled to said reset control terminal and remaining stages of said each series of flip-flops have reset terminals coupled to said reset control terminal, whereby when a reset signal is applied to said reset control terminal said first stage of said each series of flip-flops is set to a count value of one and said remaining stages of said each series of flip-flops are reset to a count value of zero.

27. The improvement according to claim 10, in which said days counter comprises a divide-by ten counter and a divide-by four counter and said months counter comprises a divide-by twelve counter.

28. The improvement according to claim 27, in which said flip-flops are coupled to said divide-by four counter and said divide-by twelve counter by the action of said change-over means in said alarm function, whereby said days counter and said months counter are converted into said minutes memory counter and said hours memory counter in said alarm function.

29. The improvement according to claim 28, in which said counter means further comprises a control terminal coupled to said days counter and said months counter, whereby said days counter and said months counter serve to provide said calendar function in response to a control voltage applied to said control terminal.

30. The improvement according to claim 29, further comprising an automatic month-end correction device connected to said counter means for automatically resetting the contents of said counter means to correspond with the first day of the following month immediately after the end of each calendar month.

31. The improvement according to claim 30, in which said month-end correction device comprises a month-end detection circuit connected to said days counter to detect contents of said days counter which correspond to the ends of months and to generate output signals indicative thereof, a months detection circuit connected to said months counter to detect odd-numbered months, even-numbered months and February and generate output signals indicative thereof, a month-end correction signal gate connected to said days counter and said months counter and responsive to the output signals form said month-end detection circuit and said months detection circuit for generating an automatic correction signal by which said days counter is reset to a count of one corresponding to a first day of the following month and said months counter is advanced by a count of one.

32. The improvement according to claim 31, in which said counter means further comprises means for setting the date to a 29th of February during time setting.

33. The improvement according to claim 32, in which said counter means further comprises means for halting counting operations of said days counter and said months counter after the date has been set to the 29th of February.

34. The improvement according to claim 31, in which said month-end detection circuit detects count values corresponding to the 32nd day or more of the odd-numbered months, the 31st day or more of the even-numbered months and the 30th day or more of February, whereby the date is immediately set to the 1st day of the following month, with counting continuing thereafter.

35. The improvement according to claim 31, in which the contents of said divide-by ten counter of said days counter is automatically reset to a count of value of zero or one when the contents of said divide-by ten counter reaches a value of eleven or more.

36. The improvement according to claim 31, in which said months detection circuit comprises an AND-OR gate for detecting the even-numbered months.

37. The improvement according to claim 29, in which when said control terminal is applied with a control voltage such that said memory counters are provided, alarm time can be set whereas counting of days and months is discontinued.

38. The improvement according to claim 29, in which when said control terminal is applied with said control voltage such that said days and months counters are provided, the contents of said days counter are unaffected when correction is performed of the contents of said months counter and a month-end correction is performed when the contents of the days counter are corrected, said month-end correction being in conformity with the contents of said months counter.

39. The improvement according to claim 38, in which means are provided such that the contents of said months counter are unaffected when the contents of said days counter are corrected.

40. The improvement according to claim 29, in which the count of said days and months counters advances from 1 to 31 and from 1 to 12, respectively, and the count of the hours and minutes counters of said alarm memory counters advances from 0 to 59 and from 0 to 11, respectively.

41. The improvement according to claim 29, in which means are provided such that the divide-by-4 and divide-by-10 counters of said days counters are operable to begin counting at different times with respect to a standard clock signal.

42. The improvement according to claim 41, in which a first counter stage of said days counter and a first counter stage of said months counter each comprises an edge-triggered type flip-flop, and invertor means coupled to the input terminals of said first counter stages, whereby said first counter stages of said days counter and said months counter are caused to change state at their respective outputs in response to mutually opposite directions of change of input signal voltage, said input signal being applied to said invertor means.

43. The improvement according to claim 15, in which said alarm circuit comprises a transistor and a current-limiting resistor connected in series with respect to a power supply.

44. The improvement according to claim 43, in which said current-limiting resistor is coupled to an emitter of said transistor whose base electrode is coupled to receive said alarm actuating signal.

* * * * *